US007459007B2

(12) United States Patent
Goia et al.

(10) Patent No.: US 7,459,007 B2
(45) Date of Patent: Dec. 2, 2008

(54) METHOD FOR PRODUCING ULTRA-FINE METAL FLAKES

(75) Inventors: Dan V. Goia, Potsdam, NY (US); Corina Goia, Potsdam, NY (US)

(73) Assignee: Clarkson University, Potsdam, NY (US)

( * ) Notice: Subject to any disclaimer, the term of this patent is extended or adjusted under 35 U.S.C. 154(b) by 507 days.

(21) Appl. No.: 11/080,192

(22) Filed: Mar. 15, 2005

(65) Prior Publication Data

US 2006/0207385 A1 Sep. 21, 2006

(51) Int. Cl.
*B22F 9/04* (2006.01)

(52) U.S. Cl. ..... 75/354; 75/361

(58) Field of Classification Search ..... 75/354, 75/361

See application file for complete search history.

(56) References Cited

U.S. PATENT DOCUMENTS 4,863,510 A * 9/1989 Tamemasa et al. ..... 75/351
4,884,754 A * 12/1989 Kemp et al. ..... 241/5
4,921,623 A * 5/1990 Yamaguchi et al. ..... 252/512
5,175,024 A 12/1992 Mack ..... 427/216
6,395,332 B1 * 5/2002 Hanawa et al. ..... 427/216
6,676,729 B2 1/2004 Sun ..... 75/348
6,833,019 B1 * 12/2004 Lewis et al. ..... 75/345

OTHER PUBLICATIONS

R.M. Wakser and W. Kang, Fabrication and Properties of Microforged Ferromagntic Nanoflakes, 1998, IEEE Trans. Magnetics, 34:1144-1146.

S. Yoshida et al. Crystal Structure and Microwave Permeability of Very thin Fe-Si-Al Flakes Produced by Microforging, 2003, J. Appl. Phys. 93:6659-6661.

PCT International Search Report based on PCT/US2006/09413 dated Aug. 6, 2007.

* cited by examiner

*Primary Examiner*—George Wyszomierski
(74) *Attorney, Agent, or Firm*—Dinsmore & Shohl, LLP

(57) ABSTRACT

The present invention provides a metallic composition, which includes a plurality of ultra-fine copper flakes having at least one desirable feature, such as oxidation resistance and excellent dispersibility in a non-aqueous system. Also provided is a method for forming compositions having a plurality of ultra-fine copper flakes, and the metallic composition produced therewith.

16 Claims, 2 Drawing Sheets

A

B

C

A B

C

METHOD FOR PRODUCING ULTRA-FINE METAL FLAKES

FIELD OF THE INVENTION

The present invention relates generally to ultra-fine metallic compositions and methods of making thereof.

BACKGROUND OF THE INVENTION

Ultra-fine metallic particles and flakes (e.g. copper particles and flakes) have many unique physical and chemical characteristics, which make them ideal materials for a variety of applications, such as electronics, catalysis, metallurgy, and decorative. The techniques of flattening metallic particles to produce flakes is well-known in the art. However, while the protocols for processing precious metals (e.g. silver and gold) are relatively simple, the milling of metallic particles, such as ultra-fine copper particles, in an open system (i.e. with exposure to air), is a very challenging task because the particles and flakes are readily oxidized in the air. In the case of copper, the milling of copper particles to flakes was routinely performed either by excluding the oxygen from the system (i.e. using a closed system) or in the presence of agents which dissolve the copper oxides formed during milling. These procedures, however, are expensive and difficult to implement and may lead to significantly lower yields of copper flakes and require expensive waste treatment. The present invention provides an environmentally friendly, low cost milling process which generates copper flakes with an superior dispersibility in non-aqueous solvents (e.g., low and medium polarity organic solvents) and oxidation resistance.

SUMMARY OF THE INVENTION

The present invention generally provides a metallic composition, which includes a plurality of ultra-fine copper flakes having at least one desirable feature, such as oxidation resistance and excellent dispersibility in a non-aqueous system.

In one aspect, the present invention provides a method for forming compositions having a plurality of ultra-fine copper flakes, and the metallic composition produced therewith, where the plurality of ultra-fine copper flakes is obtained in accordance with a process that includes the steps of:

(a) forming a system containing a plurality of ultra-fine copper particles, a solvent, and a reducing agent;

(b) milling the plurality of ultra-fine copper particles in the system; and optionally, (c) isolating the copper flakes.

In one embodiment, the solvent may be propylene glycol. In another embodiment, the reducing agent may be ascorbic acid. The system may further include a lubricant (e.g. oleic acid) and/or a dispersant (e.g. Solsperse 27000).

Additional aspects of the present invention will be apparent in view of the description that follows.

DETAILED DESCRIPTION OF THE INVENTION

Figure 1:
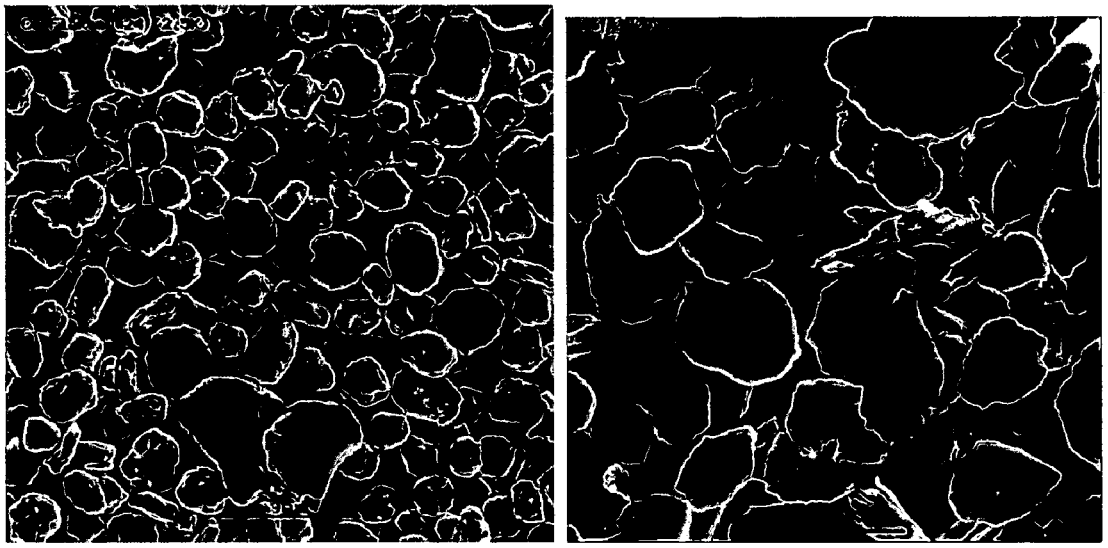
FIG. 1 includes images that illustrate the ultra-fine copper flakes produced by the method in accordance with one embodiment of the present invention. Milling time: (a) 4 hours; (b) 16 hours, and (c) 36 hours. The images were acquired using scanning electron microscope at two magnifications (5,000 and 10,000).
Figure 1:
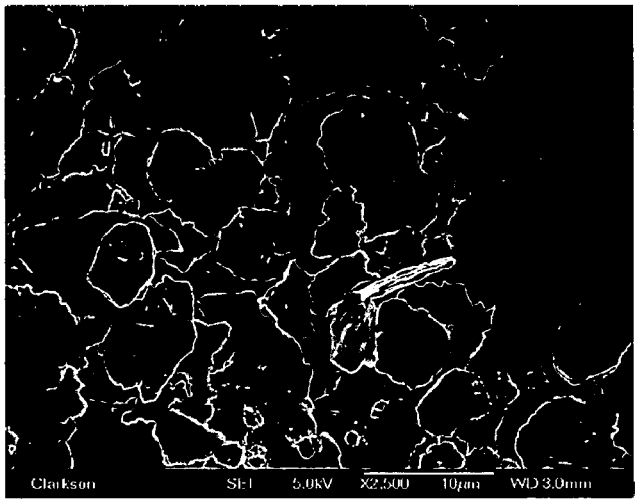
Figure 2:
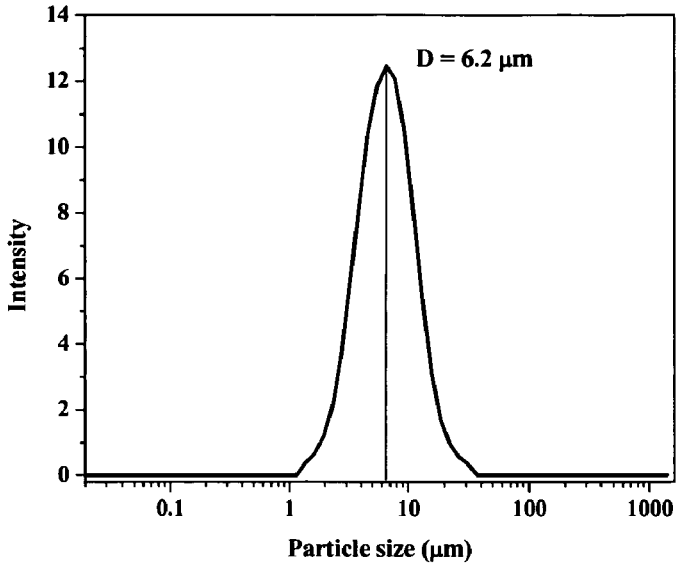
FIG. 2 shows the particle size distribution of the copper flakes of FIG. 1*b* (i.e., after 16 hours of milling).
Figure 3:
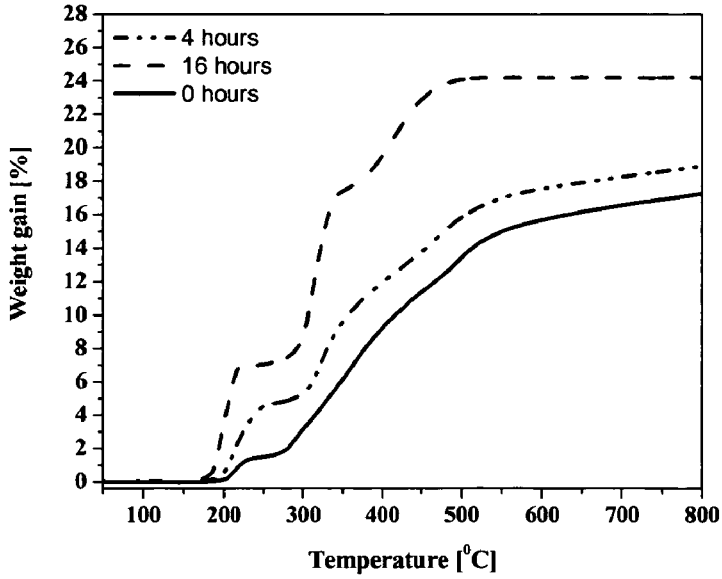
FIG. 3 depicts the TGA (thermo gravimetric analysis) of the precursor copper powders and copper flakes obtained by the method in accordance with one embodiment of the present invention. The copper flakes were obtained after 4 and 16 hours of milling, respectively.

As used herein and in the appended claims, the singular forms "a," "an," and "the" include plural references unless the content clearly dictates otherwise. Thus, for example, reference to "a particle" includes a plurality of such particles, and reference to "the reducing agent" is a reference to one or more reducing agent and equivalents thereof known to those skilled in the art, and so forth. All publications, patent applications, patents, and other references mentioned herein are incorporated by reference in their entirety.

The present invention generally provides ultra-fine copper flakes having at least one desirable feature, such as oxidation resistance and excellent dispersibility in a non-aqueous system. The present invention also generally provides a more cost effective and environmentally friendly method for producing ultra-fine copper flakes than those known in the art.

In at least one embodiment of the invention, the present method or system beneficially produces metallic compositions that include a plurality of ultra-fine copper flakes having at least one desirable feature, e.g., oxidation resistance and/or excellent dispersibility in a non-aqueous system. As used herein and in the appended claims, the term "ultra-fine copper flakes" generally includes copper flakes having the largest dimension of about 10 nm-100 μm, preferably, about 100 nm-50 μm, and more preferably, about 500 nm-20 μm, and thickness of about 5 nm-1,000 nm or about 10 nm-500 nm.

The ultra-fine copper flakes produced with the system of the present invention may have an excellent dispersibility in a non-aqueous system.

The ultra-fine copper flakes produced in accordance with the present invention may be resistant to oxidation. In one embodiment, the ultra-fine copper flakes of the present invention undergo minimal or insubstantial oxidation when exposed to the air in ambient environment for about 12 months or longer. Oxidation is generally minimal or insubstantial if the ultra-fine copper flakes display an increase of less than about 5-10% in their oxygen content as measured by the LECO combustion method. In another embodiment, the ultra-fine copper flakes of the present invention do not undergo substantial oxidation when exposed to temperatures of up to 100° C. in ambient environment for about 120 minutes. In still another embodiment, the overall weight gain of the plurality of ultra-fine copper flakes is minimal or insubstantial when they are heated in the air at 20° C./minute up to about 170° C.

The present invention also provides methods for producing ultra-fine copper flakes, and ultra-fine copper flakes produced therewith, that, in one embodiment, are obtained by: (a) forming a system comprising a plurality of ultra-fine copper particles, a solvent, and a reducing agent; (b) milling the plurality of ultra-fine copper particles in the mixture; and optionally, (c) isolating the copper flakes. As used herein and in the appended claims, the term "ultra-fine copper particles" generally includes copper particles having diameters of about 1 nm-100 μm, about 50 nm-50 μm, or about 500 nm-20 μm. Methods for producing ultra-fine copper flakes are known in the art. In one embodiment, ultra-fine copper particles may be obtained in accordance with the methods disclosed in U.S.

patent application Ser. No. 10/981,077, filed on Nov. 3, 2004, which is hereby incorporated by reference herein in its entirety.

The term "solvent," as used herein and in the appended claims, generally includes any solvent, and a combination thereof, which provides a suitable condition for dispersing the ultra-fine copper particles and which is suitable for dissolving the reducing agent, and optionally, a lubricant and a dispersant. The solvent may be a water-soluble or a water-insoluble organic solvent. Examples of water soluble organic solvents include, but not limited to, water-soluble glycol derivative organic solvents, e.g., ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether, and ethylene glycol monophenyl ether. Other solvents may also be used, such as, methanol, ethanol, ethylene dichloride, cyclohexanone, cyclopentanone, 2-heptanone, gamma-butyrolactone, methyl ethyl ketone, toluene, ethyl acetate, methyl lactate, ethyl lactate, methyl methoxypropionate, ethyl ethoxypropionate, methyl pyruvate, ethyl pyruvate, propyl pyruvate, N,N-dimethylformaide, dimethyl sulfoxide, N-methylpyrrolidone and tetrahydrofuran. In one embodiment of the present invention, the solvent may be propylene glycol.

The term "reducing composition" or "reducing agent," as used herein and in the appended claims, generally includes any reducing substance, and a combination thereof, which is suitable for preventing, reducing, minimizing, and/or eliminating the oxidation of the ultra-fine copper particles or flakes during the milling process, including, without limitation, acylaminophenol compounds, alkylated hydroquinone compounds, alkylated phenol compounds, alkylthiomethylphenol compounds, amine-based antioxidants, ascorbic acid, ascorbic stearic acid esters, O-, N-, or S-benzyl compounds, bisphenol compounds, butylhydroxyanisole, compounds having a thioether bond, dibutylhydroxytoluene, docosahexaenoic acid, free radical scavenger, hydroxybenzyl compounds, hydroquinone compounds, linolenic acid, icosapentaenoic acid, melatonin, nordihydroguaiaretic acid, peroxide scavengers, phosphnate compounds, thiodiphenylether compounds, tocopherols and their ester derivatives, and water-soluble or water-insoluble antioxidants. The reducing agent may be a naturally-occurring, a synthetic, or a semi-synthetic product. In one embodiment of the present invention, the reducing agent is ascorbic acid.

The milling system of the present invention may further contain a lubricant. The term "lubricant," as used herein and in the appended claims, generally includes any suitable lubricating substance, and a combination thereof, which is capable of reducing friction by making surfaces smooth, including, without limitation, wax, fat, oil, mineral oil, vegetable oil, grease, fatty acids, silicon-based oils (e.g. polyalkyl-, polyaryl-, polyalkoxy-, or polyaryloxy-siloxane oils and silicate oils), hydrocarbon oils and halo-substituted hydrocarbon oils (such as, polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)- benzenes, and the like; polyphenyls such as biphenyls, terphenyls, alkylated polyphenyls, and the like; alkylated diphenyl ethers and alkylated diphenyl sulfides and the derivative, analogs and homologs thereof), the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol) (e.g. dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, and the 2-ethylhexyl diester of linoleic acid dimer). The lubricant may be a naturally-occurring, a synthetic, or a semi-synthetic product. In one embodiment of the present invention, the lubricant may be oleic acid.

The milling system of the present invention may further contain a dispersant. Examples of dispersants may include, but are not limited to, Solsperse 27000, sodium dodecyl sulfate (SDS), Triton X-100, CHAPS, NP-40 and Tween 20. The dispersant may be a naturally-occurring, a synthetic, or a semi-synthetic product. In one embodiment of the present invention, the dispersant is Solsperse 27000.

The temperature of the system may be controlled to facilitate the milling process. It may be commanded by a number of factors, such as the types of solvent, reducing agent, lubricant, and/or dispersant used. For example, when ascorbic acid is used as the reducing agent, a temperature of at least about 65° C. may be preferred. Furthermore, a higher milling temperature also significantly reduces the milling time, and thus the cost of producing the ultra-fine copper flakes, as the ductility of the metal may improve at a higher temperature.

The ultra-fine copper particles may be milled using any suitable milling mechanism known in art, such as, ball-milling, attritor milling, high energy bead (sand) milling, and basket milling. For example, ultra-fine copper flakes may be formed by milling the ultra-fine copper particles in an attritor, where the attritor contains a plurality of beads or balls. The beads may be made of any suitable materials, such as, metals (e.g., steel), glasses, ceramics, polymers, and the combinations thereof.

The resulting ultra-fine copper flakes may be obtained following standard protocols known in the art, such as by precipitation, filtration, and centrifugation. The copper flakes may further be washed, such as by using methanol or ethanol, and dried (with or without heating), such as by air, $N_2$, or vacuum.

EXAMPLES

The following example illustrate the present invention, which is set forth to aid in the understanding of the invention, and should not be construed to limit in any way the scope of the invention as defined in the claims which follow thereafter.

The following milling process for making ultra-fine copper flakes was developed to eliminate or minimize the shortcomings of the approaches known in the art. The process of the present invention includes milling a plurality of copper particles in propylene glycol in the presence of a lubricant (e.g., oleic acid), a dispersant (Solsperse 27000), and a reducing agent (e.g., ascorbic acid). The temperature of the milling system, i.e, the mixture, was maintained at 65° C. during the process. In addition of providing a suitable condition for ascorbic acid to function effectively against oxidation, a higher milling temperature also significantly reduces the milling time because the ductility of the metal improves at higher temperature.

Example 1

Preparation of Copper Flakes

A 01-HD Union Process bench attritor, equipped with a 1.4 L milling tank containing 3.7 kg of chrome steel balls (2 mm diameter), was used for the milling process. The temperature during the milling was maintained at 65° C., using a Neslab RTE-740 circulator.

The milling system contains 230 g propylene glycol, 16 g ascorbic acid, 46 g Solsperse 27000, 8 g oleic acid, and 800 g ultra-fine copper particles. Propylene glycol, ascorbic acid, Solsperse 27000, and oleic acid were pre-mixed at 30-35° C. After ascorbic acid was dissolved, the solution was transferred into the tank of the attritor. The copper particles were added gradually to the solution. The speed of the attritor was kept at 200 rpm. After the addition of the copper particles was completed, the slurry was mixed at the same speed for 30 minutes. At the end of the mixing period the speed of the attritor was increased to 400 rpm. The copper particles were milled for up to 36 hours. When the milling process was finished, the mixture containing copper flakes was unloaded into a 4.0 L beaker where it was washed 4 times with alcohol. The alcohol was recycled by distillation. After the last wash the slurry was poured into trays and dried at about 90° C. for two hours in a regular air circulation oven or in a vacuum oven purged with an inert gas (e.g., nitrogen or argon).

Additional experiments were also conducted under conditions similar to those of Example 1, with quantities of copper powder varying from about 100 g to about 1,200 g.

Discussed below are results obtained by the inventors in connection with the experiments of Example 1:

Six lots of Cu flakes were produced using the milling process described above. By changing the milling time and the amount of cooper particles used, flakes with various degree of "flattening" were produced. Medium loadings of cooper particles (e.g., ~5-800 g) and longer milling time (e.g., over 16 h) favored the formation of fully developed flakes with low tapped density ("TD"), which may be suitable for a number of applications, such as, electromagnetic interference ("EMI") shielding. By reducing the milling time (e.g., down to about 4 hours) and increasing the amount of cooper particles used (e.g., up to about 1,100 g), more "powdery" flakes with increasingly higher TD were produced. Such materials may be more suitable than the fully developed flakes in base metal ("BM") termination applications. On the other hand, by decreasing the copper powder loading, such as to less than about 300 g and increase the milling time, very high aspect ratio copper flakes were obtained, which may be used as effective IR obscurant materials. The SEM images of the ultra-fine copper flakes obtained at 4, 16, and 36 hours are shown in FIG. 1.

While the foregoing invention has been described in some detail for purposes of clarity and understanding, it will be appreciated by one skilled in the art, from a reading of the disclosure, that various changes in form and detail can be made without departing from the true scope of the invention in the appended claims.

What is claimed is:

1. A method for forming a plurality of ultra-fine copper flakes comprising:

(a) forming a system comprising a plurality of ultra-fine copper particles, a solvent, and a reducing agent;

(b) milling the plurality of ultra-fine copper particles in the system at a temperature of at least 65° C., so as to facilitate the milling process and reduce milling time; and optionally, (c) isolating the copper flakes.

2. The method of claim 1, wherein the solvent is propylene glycol.

3. The method of claim 1, wherein the reducing agent is ascorbic acid.

4. The method of claim 1, wherein the system further comprises a lubricant.

5. The method of claim 4, wherein the lubricant is oleic acid.

6. The method of claim 1, wherein the system further comprises a dispersant.

7. The method of claim 1, wherein the plurality of ultra-fine copper flakes is resistant to oxidation.

8. The method of claim 7, wherein the plurality of ultra-fine copper flakes exhibits minimal oxidation for 12 months in ambient environment, wherein oxidation is minimal when the oxygen content of the ultra-fine copper flakes is less than about 5-10% at the end of such period of time.

9. The method of claim 7, wherein the plurality of ultra-fine copper flakes exhibits minimal oxidation when exposed to temperatures up to 100° C. for about 120 minutes in air.

10. The method of claim 7, wherein the plurality of ultra-fine copper flakes exhibits minimal oxidation when heated in air at 20° C./minute up to 170° C.

11. The method of claim 1, wherein the ultra-fine copper flakes has a high dispersibility in a non-aqueous system.

12. The method of claim 1, wherein the system comprises at least one organic solvent.

13. A method for forming a plurality of ultra-fine copper flakes comprising:

(a) forming a system comprising a plurality of ultra-fine copper particles, a solvent, a lubricant, a dispersant, and a reducing agent;

(b) milling the plurality of ultra-fine copper particles in the system at a temperature of at least 65° C., so as to facilitate the milling process and reduce milling time; and optionally, (c) isolating the copper flakes.

14. The method of claim 13, wherein the solvent is propylene glycol.

15. The method of claim 13, wherein the reducing agent is ascorbic acid.

16. The method of claim 13, wherein the lubricant is oleic acid.

* * * * *